US006599632B1

(12) United States Patent
Gillette et al.

(10) Patent No.: US 6,599,632 B1
(45) Date of Patent: Jul. 29, 2003

(54) COMPOSITE SYSTEM AND METHOD FOR REINFORCEMENT OF EXISTING STRUCTURES

(75) Inventors: Karl Gillette, Richmond, CA (US); Doyle G. Dixon, Martinez, CA (US); Richard Martin, Sonoma, CA (US); Richard J. Molton, Lafayette, CA (US)

(73) Assignee: Edge Structural Composites, LLC, Point Richmond, CA (US)

( * ) Notice: Subject to any disclaimer, the term of this patent is extended or adjusted under 35 U.S.C. 154(b) by 0 days.

(21) Appl. No.: 09/837,892

(22) Filed: Apr. 18, 2001

(51) Int. Cl.[7] ..... B32B 9/04; B32B 27/12; B05D 3/12; E04C 2/14

(52) U.S. Cl. ..... 428/447; 428/297.4; 428/300.4; 428/423.1; 428/521; 428/522; 427/369; 156/71; 52/309.1; 52/309.13; 52/309.16

(58) Field of Search ..... 428/320.2, 297.4, 428/300.1, 300.4, 413, 414, 447, 423.1, 521, 522; 427/384, 385.5, 386, 387, 369; 156/71; 52/309.1, 309.13, 309.16

(56) References Cited

U.S. PATENT DOCUMENTS

| | | | | | |
|---|---|---|---|---|---|
| 4,010,617 | A | | 3/1977 | Fisher | |
| 4,427,802 | A | | 1/1984 | Moulton et al. | |
| 4,467,071 | A | | 8/1984 | Dawdy | |
| 4,680,076 | A | | 7/1987 | Bard | |
| 4,804,427 | A | * | 2/1989 | Paul et al. | 156/180 |
| 5,043,033 | A | | 8/1991 | Fyfe | |
| 5,165,989 | A | * | 11/1992 | Bhatnagar et al. | 428/408 |
| 5,204,386 | A | * | 4/1993 | Ersun-Hallsby et al. | 523/443 |
| 5,218,810 | A | | 6/1993 | Isley, Jr. | |
| 5,421,935 | A | | 6/1995 | Dixon et al. | |
| 5,505,030 | A | | 4/1996 | Michalcewiz et al. | |
| 5,571,369 | A | | 11/1996 | Dixon et al. | |
| 5,607,527 | A | | 3/1997 | Isley, Jr. | |
| 5,632,925 | A | | 5/1997 | Moulton et al. | |
| 5,633,057 | A | | 5/1997 | Fawley | |
| 5,649,398 | A | | 7/1997 | Isley, Jr. et al. | |
| 5,657,588 | A | | 8/1997 | Axon | |
| 5,675,595 | A | | 10/1997 | Jani | |
| 5,680,739 | A | | 10/1997 | Cercone et al. | |
| 5,726,216 | A | * | 3/1998 | Janke et al. | 522/129 |
| 5,785,419 | A | | 7/1998 | McKelvey | |
| 5,925,579 | A | | 7/1999 | Neuner et al. | |
| 5,935,508 | A | | 8/1999 | Fernyhough et al. | |
| 6,003,276 | A | | 12/1999 | Hegemier et al. | |
| 6,108,998 | A | | 8/2000 | Dumlao | |
| 6,123,485 | A | | 9/2000 | Mirmiran et al. | |
| 6,124,408 | A | * | 9/2000 | Wang et al. | 525/189 |
| 6,140,420 | A | | 10/2000 | Sehanobish et al. | |
| 6,219,991 | B1 | | 4/2001 | Salek-Nejad | |
| 6,313,257 | B1 | * | 11/2001 | Abbey | 252/182.17 |

OTHER PUBLICATIONS

Bascom, et al., "The fracture of an epoxy polymer containing elastomeric modifiers", Journal of Materials Science, vol. 16, pp. 2657–2664 (1981).

Moulton, et al., "Thermoset Matrix Modification—A Model Study For Enhanced Toughness In HMG Composites", Hexcel, pp. ii–27 (Sep. 1981).

Bascom, et al., "The Interlaminar Fracture of Organic–Matrix Composites, I Woven Reinforcements", Naval Research Laboratory, 42 pages (no date).

Ting, "Fracture Properties Of Elastomers–Toughened Epoxies", Naval Research Laboratory, 14 pages (no date).

Edge Structural Composites, "Preparing for the Future", 4 pages (no date).

* cited by examiner

*Primary Examiner*—Robert Dawson
*Assistant Examiner*—Michael J Feely
(74) *Attorney, Agent, or Firm*—Burns, Doane, Swecker & Mathis, L.L.P.

(57) ABSTRACT

A method of reinforcing an external surface of a structural member including the steps of applying to a surface a fiber reinforced polymer system, and curing or hardening the polymer system. The polymer system is characterized by including a single-phase homogenous system before curing or hardening and becoming a two-phase system upon curing. The polymer system results in, when cured, a structural polymer including a continuous phase and an elastomeric polymer discontinuous phase.

20 Claims, No Drawings

COMPOSITE SYSTEM AND METHOD FOR REINFORCEMENT OF EXISTING STRUCTURES

FIELD OF THE INVENTION

The present invention relates to composites for structure reinforcement, particularly to fiber reinforced polymer systems for retrofit reinforcement of existing structures, particularly concrete structures.

BACKGROUND OF THE INVENTION

With the advent of composite materials such as fiberglass, carbon fiber, Kevlar and similar materials there became a need for resins which are capable of utilizing the strengths of the composite materials. The development of resins for use with composite materials has greatly expanded due to the increased popularity of composite materials. For example, composite materials retained within a resin are utilized in sporting goods, aircraft, automobiles and thousands of other products.

In each application it is necessary to select an appropriate resin. For example, in some applications it is desirable to include a pre-determined amount of flexibility in the overall design, therefore a resin must be chosen that is capable of providing strength and stiffness to the composite fibers as well as retain a pre-determined amount of flexibility suitable for the desired end use. In other applications a resin may be chosen for its strength and hardness for resistance to mechanical impacts. Epoxy resins are conventionally used in both molding and laminating techniques to make fiber-reinforced articles with various desired mechanical strengths, chemical resistance and electrical insulating properties.

As a result of these needs, thousands of resins have been developed for use with composite fibers. Each of the resins having different mechanical properties, thereby allowing a manufacturer to chose a resin that is appropriate for the end use of the product.

One type of resin commonly used to retain the composite fibers is a thermosetting resin. Thermosetting resins are usually used because when they "set" they are irreversibly solidified. Other types of resin commonly used include thermoplastic resins, which have different properties compared to thermoset resins and can soften at elevated temperatures, even after they are cured.

Composite fibers disposed within a curable polymer matrix may be utilized to strengthen, support, and/or repair damaged building structures, or to prevent damage or collapse. For example, as described in U.S. Pat. No. 5,043,033 to Fyfe, incorporated herein by reference in its entirety, a concrete column supporting an overhead load may be strengthened by wrapping the work area of the column with at least one layer of high-strength, stretchable fibers. After wrapping the column a hardenable material, having a modules at least as great as that of the fibers overlaying the structure, is applied to the fibers and allowed to cure, thereby forming a hard outer shell. U.S. Pat. No. 5,218,810 to Isley, incorporated herein by reference in its entirety, contains a similar disclosure of fabric-resin matrix reinforced concrete columns.

In U.S. Pat. No. 5,505,030 to Michalcewiz et al., incorporated herein by reference in its entirety, there is described a method of reinforcing concrete, wood, or steel support columns, beams or other structures. The method includes disposing pre-formed reinforcing layers constructed of engineering materials having a high tensile strength and a high modulus that are attached, via an adhesive, thereby increasing the compressive, shear, bending, ductility, and/or seismic load carrying capability. U.S. Pat. No. 5,633,057 to Fowley, incorporated herein by reference in its entirety, contains a similar disclosure of fabric-resin matrix reinforced concrete columns.

In U.S. Pat. No. 6,003,276, to Hegemier et al., incorporated herein by reference in its entirety, there is described a method of reinforcing walls with composite materials, wherein the walls are covered with composite materials disposed within a curable matrix and aligned in a pre-determined direction to externally reinforce the wall against in-plane horizontal forces as well as out-of plane forces.

U.S. Pat. No. 5,680,739 to Cercone et al., U.S. Pat. No. 6,108,998 to Dumlao and U.S. Pat. No. 6,123,485 to Mirmiran et al., all incorporated herein by reference in their entirety, disclose additional approaches to composite reinforcement of existing structures.

In the references above, the composite materials are retained in a curable matrix, typically an epoxy matrix. The curable epoxy matrix may be further disposed upon the structure to which the composite materials are to be attached, thereby increasing the adhesion of the composite fibers to the structures.

One of the problems encountered in the conventional systems for composite reinforcement of structural elements, including those systems disclosed in the above patents, is that when the structural elements are stressed beyond their structural limits and cracks develop in the structure, those cracks are then propagated into the composite reinforcement which has been adhered to the surface of the structural element. The conventional approach to prevent propagation of the cracks and structural failure through the composite reinforcement system has been to use stronger fibers or matrix materials to provide increased strength for the overall reinforcement system.

It is an object of this invention to provide an improved composite reinforcement system for existing structural elements to provide increased resistance to crack propagation and increased resistance to structural failure.

It is a further object of this invention to provide an improved polymer system for improved performance of the composite reinforcement of structures.

SUMMARY OF THE INVENTION

In one aspect, this invention provides a method of reinforcing an external surface of a structural member comprising: applying to said surface a fiber reinforced polymer system; and curing or hardening the polymer system, wherein the polymer system is characterized by comprising a single phase homogeneous system before curing or hardening and by becoming a two phase system during curing, thereby resulting in, when cured, a structural polymer continuous phase and elastomeric polymer discontinuous phase.

In another aspect, this invention provides a reinforced structure comprising a structural member having an external surface and a fiber reinforced polymer system adhered to said surface, wherein the polymer system is characterized by a cured two-phase system comprising a structural polymer continuous phase and an elastomeric polymer discontinuous phase.

In another aspect, this invention provides a reinforced structure comprising a structural member having an external surface and a fiber reinforced polymer system adhered to said surface, wherein the polymer system is characterized by comprising a single phase homogenous system capable of becoming during curing a two-phase system comprising a structural polymer continuous phase and an elastomeric polymer discontinuous phase.

In another aspect, this invention provides a liquid polymer system that is easy to use in conventional fiber reinforcement of existing structural elements either through layup or prepreg applications. The present system is provided in a two part liquid polymer system which is mixed at the time of use. The first part of the polymer system comprises a structural polymer, typically an epoxy resin or other thermoset resin used for structural reinforcement applications, which is a "toughened" resin. Such "two phase" or "second phase" polymers are typically but not limited to epoxies containing a toughener, like a butadiene rubber or elastomer resin. During curing an immiscible phase forms whereby the epoxy cures as the continuous structural polymer, and a portion of the elastomer separates out and cures as isolated domains of cured elastomer. The second part of the liquid system is an elastomeric polymer, such as a urethane or butadiene polymer. The first and second liquid parts are miscible when mixed and form a single phase liquid at the time of mixing with sufficient work time to allow applications to desired structures by the worker in a conventional method. When the two part liquid polymer system of this invention goes through the process of curing, the system at some point in time begins to form a two phase system, either at the beginning of the curing process, during the curing process and/or towards the end of the curing process. The structural polymer forms a continuous phase as it cures and the elastomeric polymer forms a discontinuous phase as it cures. The elastomeric discontinuous polymer phase is cured in very small or microscopic balls or other shapes, which are dispersed or distributed substantially evenly throughout the continuous structural polymer phase. The two phase curing of the polymer system of this invention results inherently from the selection of the appropriate first part and the second part of the polymer system, without any special attention or procedure required by the worker applying the system at the end use site. The polymer systems of this invention are used and cured in the same manner as conventional composite systems, but the combination of the structural polymer and the elastomeric polymer of this invention provides improved reinforced strength for various types of structures.

DESCRIPTION OF THE INVENTION

This invention is applicable to the structural reinforcement of any typical structural member to which composite reinforcement systems can be applied, such as disclosed in the above referenced U.S. Pat. Nos. 5,043,033; 5,218,810; 5,505,030 and 5,633,057, which are incorporated herein by reference. The structural members include columns, walls, beams, slabs, etc. The only requirement is that at least one surface of the structural member to be reinforced the sufficiently exposed to a working space so that a worker can apply the fiber matrix and the polymer reinforcement system to the surface of the a structural member. The structural members to which the system of this invention can be applied are typically concrete members, but maybe iron, steel, masonry, wood, etc. It will be apparent to one skilled in the art following the teachings herein that the polymer systems of this invention can be formulated for maximum adherence to any particular structural member surface for maximum effect.

The resin system of this invention comprises two parts. The first part contains a structural polymer and a "toughener" which can be elastomeric or rubber type polymer. The second part is a hardener, like an amine polymer. The system of this invention can typically include other components such as catalysts, accelerators, diluents, cross-linkers, or other additives conventionally used in the general types of resins used in the present invention.

The "structural polymers" referred to and used in this invention are known in the art and are typically thermosetting resins, such as epoxy resins, which are the most common for structural reinforcement uses, but may include other thermosetting resins such as phenolics, polyesters, alkyds, and acrylics, such as referred to in U.S. Pat. No. 6,108,998 referred to above. These thermosetting resins which are useful as the structural polymer component of the present invention are cured by chemical crosslinking and once cured remain rigid and retain their cured shape, regardless of normal temperature conditions. The structural polymer component for use in this invention is selected for the appropriate tensile strength, elasticity, and its ability to adhere to the surface of the structural member to which the reinforcement system is to be applied. The structural polymer is also selected to be compatible with and adhere properly to the fiber reinforcement matrix selected for use in the system. Other important features include safety in handling, work time after the components are mixed and the total cured time until maximum structural strength is achieved. In some instances it may be appropriate to use a thermoplastic resin as part of the structural polymer component in this invention, provided that the resin meets the requirements for strength, adherence, and installation conditions. Another requirement for the structural polymer component of this invention, whether it is a thermoset resin or a thermoplastic resin, is being initially miscible with the elastomeric polymer component, so that it is capable of forming essentially a homogeneous, single phase liquid for mixing with the second part or hardener for application to the fiber matrix and the surface of the structural member to be reinforced.

The "elastomeric polymers" referred to and used in this invention are known in the art and are typically rubber type resins, such as butadienes, urethanes, styrenebutadiene copolymers, neoprene, nitrile rubber, silicone rubber and the like. The elastomeric polymer component of this invention is selected to be initially miscible with and compatible with the liquid structural polymer in the initial mixture before curing, so that it forms essentially a homogeneous, single phase liquid for application to the fiber matrix and the surface of the structural member to be reinforced. It is also selected to become immiscible with the structural polymer after the polymers begin to cure. As the elastomeric polymer become immiscible and forms a two-phase system, and while the structural polymer cures, the elastomeric polymer is isolated in compartmentalized domains of small to microscopic size and cures as a discontinuous phase. In general, the isolated domains of elastomeric polymer are substantially evenly distributed throughout the structural polymer whereby the structural polymer is a continuous phase and the elastomeric polymer is a discontinuous phase. Another attribute of the elastomeric polymer is that it is selected with reactivity and appropriate end groups so that as the elastomeric polymer cures it may also to some extent crosslink with the structural polymer.

In another embodiment, the part one polymer may be initially a two phase system wherein the structural polymer is a liquid phase and the elastomeric polymer is a cured or partially cured elastomeric polymer in solid form, such as a fine powder dispersed in the liquid structural polymer. When the structural polymer cures, it forms the continuous phase, encasing and entrapping the elastomeric polymer particles as the discontinuous phase. This embodiment may be useful in some structure reinforcement applications, but care must be taken to keep the elastomeric polymer particles dispersed in the liquid structural polymer during application and curing.

In a preferred method of application, the present invention further includes applying the fiber reinforced polymer system by coating a plurality of fibers with the polymer system, coating the external surface of the structural member with the coated fibers, and then applying a force to the coated fibers thereby embedding the fibers within the polymer system.

It will be apparent to one skilled in the art following the disclosure herein that each of the structural polymer and the elastomeric polymer components of this invention can be selected according to the properties and conditions desired. Each polymer can be selected with respect to chain length, molecular weight, saturation or unsaturation, curing mechanism and cure times as desired depending on performance properties desired for a particular structural reinforcement. Each of the two polymer components may be thermally cured, catalytically cured, moisture cured or cured using other curing mechanism as known in the art. Selection of particular polymer for use in combination of this invention requires only that the structural polymer and the elastomeric polymer be compatible and miscible in the initial liquid phase and that they become immiscible and separate into two phases at some time during the curing process. These systems are known in other contexts, for example, see The Fracture of an Epoxy Polymer Containing Elastometric Modifiers W. D. Bascom, R. Y. Ting, R. J. Moulton, C. K. Riew, and A. R. Siebert, Journal of Materials Science 16(1981) 2657–2664, incorporated herein by reference in its entirety. Also see U.S. Pat. No. 4,680,076 to Bard, incorporated herein by reference in its entirety.

Preferred polymers for use as the first part of the polymer system of this invention are "two phase" or "second phase" toughened epoxy resins, including EPON 58005 from Shell Oil, Houston, Tex. PEP 6208 or PEP 6210 from Pacific Epoxy Polymer, Kansas City, Mo. or DR-5 or DR-7 from Applied Poleramics Inc., Benicia, Calif. These two phase toughened epoxies are typically epoxies modified with an elastomer or rubber, such as CTBN (carboxy terminated butadiene nitrile polymer). These resins are liquid and homogenous single phase systems at ambient temperature in the uncured state. As these resins cure, they form a two phase immiscible system wherein by the time the system is cured, the continuous phase is primarily epoxy resin referred to herein as the structural polymer, and the discontinuous phase is primarily the elastomeric resin, referred to herein as the elastomeric polymer. It is expected that there is some crosslinking between the interface between the phases when fully cured and that there may be some of the elastomeric resin crosslinked as part of the epoxy resin, and vice versa, although such has not been quantified.

The above first part may be used with conventional second part hardeners known in the art and described in the patents referred to above. However, preferred part two hardeners are urethane modified amines TA-1 or TA-2 from Applied Poleramics Inc., Benicia, Calif.

The ratios of the first part and second part used are conventional and known in the art for two part epoxy/hardener systems. Typically the weight ration is about 35 to about 70 parts part two per 100 parts part one, preferably about 40 to about 60 parts and most preferably about 55 parts. In addition, an additive may be used to enhance bonding to certain fibers, such as glass fibers, and to certain structural substrates, such as concrete. For example a polysiloxane and preferably an epoxy terminated polysiloxane may be added to part one before curing in about 0.1 to 5% by weight based on the weight of part one, preferably about 0.3 to 2% and most preferably about 1% by weight.

Similarly, primer coatings, especially on concrete structures, may be advantageous. A primer may be a part one diluted to a low viscosity with a low viscosity part two, especially a low viscosity urethane modified amine.

The polymer systems of this invention are useful with fiber and matrix systems conventionally used in structure reinforcement, as disclosed in the patents referred to above. However, a particularly preferred fiber system is that disclosed in co-pending U.S. patent application Ser. No. 9/838,584 filed Apr. 18, 2001 entitled "BUILDING FOUNDATION ATTACHMENT STRUCTURES AND METHODS", which is incorporated herein by reference in its entirety. Other fiber arrangements may be used as will be apparent to one skilled in the art. The fibers may be carbon, glass, or polymeric, such as KEVLAR, Cellulose, etc.

What is claimed is:

1. A method of reinforcing a building or bridge, comprising:

applying a fiber reinforced polymer system to an external surface of a structural member of the building or bridge; and curing or hardening the polymer system, wherein the polymer system is characterized by comprising a single-phase homogenous system before curing or hardening and becoming a two-phase system upon curing resulting in, when cured, a structural polymer continuous phase and an elastomeric polymer discontinuous phase.

2. The method according to claim 1, wherein the fiber reinforced polymer system includes a plurality of fibers and a polymer system.

3. The method according to claim 2, wherein the fibers are carbon fibers.

4. The method according to claim 2, wherein the fibers are S-glass fibers.

5. The method according to claim 2, wherein the fibers are E-glass fibers.

6. The method according to claim 2, wherein the fibers include a combination of carbon fibers and E-glass fibers.

7. The method according to claim 2, wherein the fibers include a combination of carbon fibers and S-glass fibers.

8. The method according to claim 1, wherein the fiber reinforced polymer system cures in air.

9. The method according to claim 1, wherein applying the fiber reinforced polymer system includes coating a plurality of fibers with the polymer system, coating the external surface of the structural member with the coated fibers, and applying a force to the coated fibers thereby embedding the fibers within the polymer system.

10. A reinforced structural member of a building or bridge, comprising:

a structural member of a building or bridge, the structural member having an external surface; and a fiber reinforced polymer system adhered to said surface wherein the polymer system is characterized by a cured two-phase system comprising a structural polymer continuous phase and an elastomeric polymer discontinuous phase.

11. The reinforced structural member according to claim 10, wherein the fiber reinforced polymer system includes a plurality of fibers and a polymer system.

12. The reinforced structural member according to claim 11, wherein the fibers are carbon fibers.

13. The reinforced structural member according to claim 11, wherein the fibers are carbon fibers and another fiber selected from the group consisting of aramid, fiberglass, E-glass, and S-glass.

14. The reinforced structural member according to claim 11, wherein the polymer system is further characterized in that the elastomeric polymer is chosen from the group consisting of butadienes, urethanes, styrenebutadiene copolymers, neoprene, nitrile rubber, and silicone rubber.

15. The reinforced structural member according to claim 10, further including a bonding agent.

16. A reinforced structural member of a building or bridge, comprising: a structural member of a building or bridge, the structural member having an external surface; and a fiber reinforced polymer system adhered to said surface, wherein the polymer system is characterized by comprising a single phase homogeneous system before curing or hardening and becoming a two-phase system upon curing resulting in, when cured, a structural polymer continuous phase and an elastomeric polymer discontinuous phase.

17. The reinforced structural according to claim 16, wherein the polymer system is further characterized in that the elastomeric polymer is chosen from the group consisting of butadienes, urethanes, styrenebutadiene copolymers, neoprene, nitrile rubber, and silicone rubber.

18. The reinforced structural member according to claim 16, wherein the fiber reinforced polymer system includes a plurality of fibers and a polymer system.

19. The reinforced structural member according to claim 18, wherein the fibers are carbon fibers and another fiber selected from the group consisting of aramid, fiberglass, E-glass, and S-glass.

20. The reinforced structural member according to claim 16, wherein the fiber reinforced polymer system cures in air.

* * * * *